United States Patent [19]

Zimmermann et al.

[11] 4,222,343

[45] Sep. 16, 1980

[54] COATING APPARATUS

[75] Inventors: Anton Zimmermann, Montagny-la-Ville; Roland Haenni, Giffers, both of Switzerland

[73] Assignee: Ciba-Geigy AG, Basel, Switzerland

[21] Appl. No.: 940,408

[22] Filed: Sep. 7, 1978

[30] Foreign Application Priority Data

Sep. 12, 1977 [CH] Switzerland ..... 11116/77

[51] Int. Cl.[3] ..... B05C 5/00

[52] U.S. Cl. ..... 118/325; 118/DIG. 4

[58] Field of Search ..... 118/DIG. 4, 324, 325; 427/420; 425/381

[56] References Cited

U.S. PATENT DOCUMENTS

| | | | |
|---|---|---|---|
| 3,443,277 | 6/1969 | Frielingsdorf . | |
| 3,973,062 | 8/1976 | Fahrni | 118/DIG. 4 |
| 4,019,906 | 4/1977 | Ridley | 118/DIG. 4 |
| 4,041,897 | 8/1977 | Ade | 118/DIG. 4 |
| 4,152,387 | 5/1979 | Cloeren | 425/133.5 X |

FOREIGN PATENT DOCUMENTS

| | | |
|---|---|---|
| 1928025 | 12/1969 | Fed. Rep. of Germany . |
| 1928031 | 12/1969 | Fed. Rep. of Germany . |
| 2351369 | 4/1975 | Fed. Rep. of Germany . |
| 2448440 | 4/1975 | Fed. Rep. of Germany . |
| 1210794 | 3/1960 | France . |

*Primary Examiner*—John P. McIntosh
*Attorney, Agent, or Firm*—Harry Falber

[57] ABSTRACT

Coating apparatus for producing multiple coatings on photographic bases wherein a layer of the coating material flows over each of two slideways which slope downwardly in a V form. An intermediate element is disposed in the flow gap bounded by the two slideways. The discharge edges of the slideways and of the intermediate element are disposed at substantially the same level. At this level the various layers of liquid combine to form a multilayer curtain which falls on to a base passing below to form a multiple layer thereon. The intermediate element can be a slot pourer so that the coating material issuing from its slot combines with the coating compositions supplied from the slideways.

7 Claims, 3 Drawing Figures

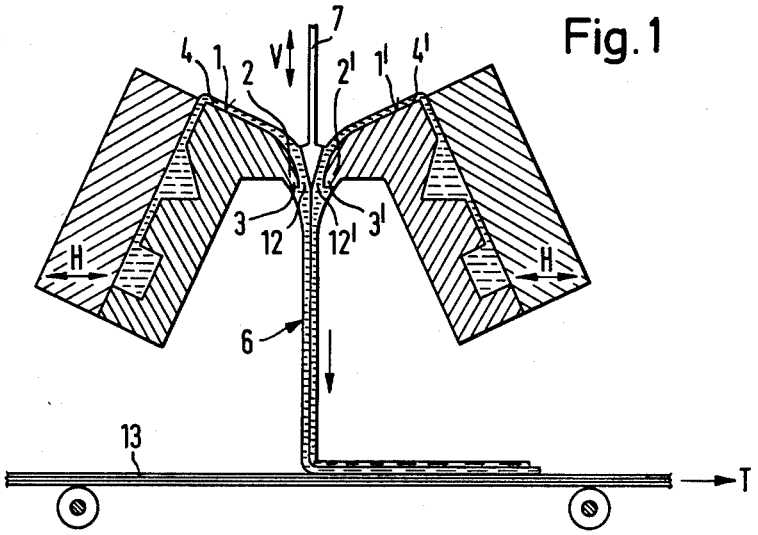
Fig. 1
Fig. 2
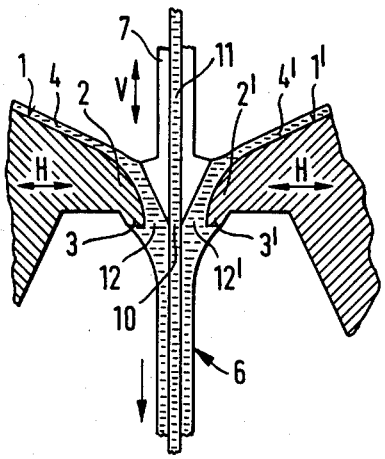
Fig. 3
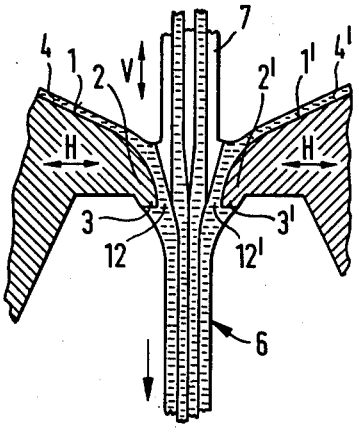

COATING APPARATUS

FIELD OF THE INVENTION

This invention relates to coating apparatus, more particularly but not exclusively to curtain coating apparatus.

A very economical way of coating photographic materials, particularly those having a large number of different layers, is for a number of layers to be applied simultaneously in a single working step.

PRIOR ART

A method known as cascade coating uses apparatus comprising a substantially prismatic block which is combined from a plurality of smaller blocks and which has a number of distributing channels equal to the number of layers to be poured, the discrete liquids for forming the layers being meteredly and supplied separately to the channels. Disposed above each channel is a substantially vertical slot and the liquid is forced up from the distributing channel by pressure inside the slots. All of the slots terminate at their top end in an exposed sloping and substantially flat surface along which the liquid descends as a cohering uniformly distributed layer. Coating apparatus of this kind are known as "coating funnels" or "slideway coaters" or, in the special form for producing several layers as "cascade coaters". The planes associated with the various slots can be coplanar or offset in relation to one another near the various slots by small steps of about the same thickness as the coating. Liquids issuing from the exit slots nearest the end of the discharge plane are flowed over laminarly by liquid issuing from exit slots higher up the discharge plane a liquid film consisting of a number of clearly separate layers finally forming at the bottom end of the discharge plane or surface. This liquid film is transferred to a moving surface to be coated either in the form of a self-supporting meniscus or in the form of a free falling curtain. In the former case, the moving surface is spaced at a small distance from the discharge surface—as a rule, fractions of a millimeter,—whereas in the second case the distance is large enough to enable a free-falling curtain to form. Apparatus of this kind can readily enable three or four or even more layers to be simultaneously formed on the surface to be treated. It has been found from experience that, if the process is performed properly, the discrete layers do not mix with one another while flowing down the inclined surface or in the self-supporting meniscus or in the free-falling curtain or on the moving surface during subsequent drying.

German Offenlegungsschrift No. 2,351,369 discloses a very advantageous form of curtain coater which can apply a number of layers simultaneously and in which two or more separate units are used to form the free-falling curtain, the various units being devised so as to make it possible for each and any of them alone to form a single layer or a multilayer curtain. The units are positioned relative to one another so that the liquid layers initially formed on them combine near the discharge edge to form a multilayer film, thereafter to drop as a multilayer free-falling curtain on to the carrier or base moving below the units. In a preferred construction this apparatus has two slideways whose surfaces are arranged in a V formation and each of which have a curved discharge lip; the discharge edges thereof being disposed at the same height and at a small distance from one another substantially corresponding to the total thickness of the liquid curtain. Other embodiments relate to the introduction of other liquid layers either on the slideway of one or of two of the slideways or vertically above the centre of the gap bounded by the two parallel discharge lips. A detailed description of the advantages of such systems is given in this Offenlegungsschrift.

Also in German Auslegeschrifts Nos. 1,928,025 and 1,928,031, coating methods using free-falling liquid curtains call for the observance of certain conditions to ensure that the free-falling curtain is stable and free of disturbances which could cause the curtain to weave or break up. One such important condition is the maintenance of a minimum throughflow necessary to ensure that the curtain once formed does not break up spontaneously or separate into discrete partial flows. Disturbances causing the curtain to break up can be in the form of oscillations caused e.g. by movement of the air around the curtain; other disturbances are connected with particles and gas bubbles included in the liquid film and causing local weakening of film coherence. A free-falling liquid curtain can be regarded as stable when any disturbance which would cause local and instantaneous rupture is self-curing.

The minimum necessary mass flow for this condition is very closely connected with the viscosity and surface tension of the liquid layers and with the geometry of the system, more particularly near the discharge lip, and approximately 0.5 ml/sec per cm of curtain width is regarded as the minimum. However, it has been found in practice that much larger specific throughflows are required for undisturbed operation, typical figures being from 2 to 3 times the amounts specified—i.e. between 1.0 and 1.5 ml. $sec.^{-1}$ $cm^{-1}$. It is therefore difficult to apply thin layers to a base by curtain coating. One solution to the problem is e.g. to move the base through the coating zone very fast; unfortunately, the continuous drier which usually follows the coater must then have a correspondingly high evaporation ability.

German Offenlegungsschrift No. 2,448,440 discloses another process for making a liquid curtain stable at relatively low throughputs. The method consists of imparting to a narrow liquid zone at opposite edges of the curtain a flow rate and possibly a viscosity which is higher than in the remainder of the curtain. The central zone of the curtain, which typically can be more than 98% of total curtain width, can then be operated at very low specific throughputs without risk to curtain stability. Despite its obvious advantages, this process has disadvantages. For instance, since the edge zones must be fed separately, the pourer is more expensive to construct; also, additional metering and pump system is required to supply the edge zones.

OBJECT OF THE INVENTION

It is therefore an object of this invention to provide a multicoat curtain coater wherein the minimum specific throughput required to form a stable curtain is reduced. It has been found that the problem can be solved by a surprisingly simple modification of the coater disclosed in German Offenlegungsschrift No. 2,351,369.

SUMMARY OF THE INVENTION

The invention relates to an apparatus for the simultaneous application by curtain coating of at least two layers of liquid coating materials on a strip-like base conveyed along a predetermined path, the apparatus having slideways which are each fed by way of a slot with a coating liquid. The slideways downwards in a V formation to define a flow gap which is divided into two component gaps of substantially equal width by a wedge-shaped intermediate element which narrows downwardly. The discharge edges of the element and the pouring lips of the two slideways are preferably disposed at substantially the same level. The level of the discharge edge of the intermediate element can be higher or lower; as a rule however, all three discharge edges are disposed at the same level for optimum results.

Preferably, the wedge-shaped intermediate element has one or more channels for the introduction of one or more layers between the two or more layers supplied by the slideways.

BRIEF DESCRIPTION OF THE DRAWINGS

The invention will be described in greater detail hereinafter with reference to embodiments diagrammatically shown in the accompanying drawings in which:

FIG. 1 shows a coating apparatus according to this invention with a simple form of intermediate element;

FIG. 2 shows a modification of the apparatus of FIG. 1 wherein the element is provided with one pouring channel; and FIG. 3 shows a further modification where the element has two pouring channels.

DETAILED DESCRIPTION OF PREFERRED EMBODIMENTS

FIG. 1 shows a slideway coater for multicoat curtain coating comprising two units having slideways 1,1' arranged relatively to one another in the form of a V and having curved pouring lips 2,2' terminating in discharge edges 3,3'. Disposed between the lips 2,2' is a wedge-shaped intermediate element 7 whose bottom edge is at the same level as the two discharge edges 3,3'. Consequently the flow of the two liquids 4,4' remains separate as far as the height of the edges 3,3' and only thereafter does it combine to form a free-falling combined liquid curtain 6. The same drops on to a strip 13 to be coated moving in the direction indicated by an arrow T and forms a multiple coating on the article.

Referring to the embodiment shown in FIG. 2, the wedge-shaped intermediate element 7 is a slot pourer; accordingly, the element 7 is formed with a discharge slot 10 adapted to be supplied via a channel 11. The exit orifice of slot 10 is at substantially the same level as the two discharge edges 3,3' so as to form a combined zone from which the three liquids flow to form a free-falling liquid curtain 6 having 3 layers.

The width of the gaps 12,12' between the lip 2 or 2' and the element 7 is such that the gaps completely fill up with liquid at least at the bottom region of the zone. So that this state of affairs may always be reached for different liquids of different viscosities, the gap widths are adjustable. To provide this adjustment the components which carry the slideways 1,1' are horizontally adjustable, as indicated by double arrows H, and/or the intermediate element is adjustable vertically, as indicated by a double arrow V. As shown in the drawings the entry to the gaps 12 and 12' is funnel-shaped. Gap width in the narrowest part is preferably from approximately 0.25 to 1.00 mm per feed slot of the associated slideway 1 or 1'. The drawings show each slideway as being formed with a single feed slot, but it can be formed with two or more feed slots. Similarly, the wedge-shaped element can be formed with two or more parallel exit slots so that curtains combined from four or five or more layers can be produced.

FIG. 3 shows an embodiment in which the wedge-shaped intermediate element 7 is formed with two slots.

The supply tanks, feed piping, pumps and so forth which handle the coating liquids and which are necessary to supply the coaters are generally known and have not therefore been shown.

Comparative tests show that an apparatus as shown in FIGS. 1, 2 or 3 can reduce the bottom limit for specific throughput considerably as compared with the known facilities, e.g. as disclosed by German Auslegeschrifts Nos. 1,928,025 and 1,928,031 and by German Offenlegungsschrift No. 2,351,369.

The comparative tests made were as follows:

A first gelatin solution coloured with a green-blue azo dye was mixed with 2% of isopropylnaphthalene sulphonic acid as wetting agent and diluted with water to a viscosity of 20 cP.

A second gelatin solution was mixed with the same quantity of wetting agent, coloured with a purple azo dye and also adjusted to a viscosity of 20 cP.

The coater of FIG. 1 but without the intermediate element 7 was supplied with a continuous flow of both gelatin solutions so that a continuous free-falling two-layer liquid curtain 6 was produced which after a drop of 7 cm was applied to a carrier 13 moving transversely of the curtain plane at a speed of 1.33 m/sec. A specific throughput of 0.7 $ml/sec^{-1}.cm^{-1}$ for each of the two halves of the coater—i.e. in all 1.4 $ml.sec^{-1}.cm^{-1}$ for the combined curtain—was required to produce a stable curtain unaffected by disturbances.

The same experiment was repeated but with the addition of the element 7: the liquid consumption for a stable curtain dropped to 0.525 $ml.sec^{-1}.cm^{-1}$ for each half of the coater corresponding to 1.05 $ml.sec^{-1}.cm^{-1}$ for the combined curtain. Finally, another experiment was performed for a coater of the kind shown in FIG. 2 wherein the left-hand and right-hand halves of the coater were each fed with a greenish-blue gelatin solution while the central wedge-shaped element 7 was fed with a purple coloured gelatin solution. In this case 0.3 $ml.sec^{-1}.cm^{-1}$ for each unit—i.e. a total of 0.9 $ml.sec^{31}$ $1.cm^{-1}$—was required to produce a stable curtain—i.e. only 64% of the quantity required for the apparatus of FIG. 1.

What is claimed is:

1. Coating apparatus comprising oppositely disposed slideways sloping downwardly to form a gap, each slideway including a slot through which liquid is discharged to flow down the associated slideway and an edge over which the liquid flows through said gap, the edges being positioned at substantially the same level; and an intermediate element positioned in said gap to divide it into component gaps and having sides converging symmetrically about a vertical axis and terminating at an edge substantially level with the edges of said slideways.

2. Coating apparatus according to claim 1, wherein said element includes a channel aligned on said vertical axis and terminating at the edge of the converging surfaces to enable liquid to flow down said channel and form a layer of liquid intermediate layers of liquid flowing from said component gaps.

3. Coating apparatus according to claim 2, wherein said components gaps are of substantially the same width.

4. Coating apparatus according to claim 1, wherein said element includes two channels parallel to said vertical axis and terminating at the edge of the converging surfaces to enable liquid to flow down said channels and form layers of liquid intermediate layers of liquid flowing from said component gaps.

5. Coating apparatus according to claim 1, wherein the width of each component gap at its narrowest part is between 0.25 mm and 1.00 mm.

6. Coating apparatus according to claim 1, including means for adjusting the position of the slideways to adjust the width of the component gaps and the vertical position of the intermediate element.

7. Coating apparatus comprising two oppositely facing slideways sloping downwards to define a gap, each slideway having a surface and an exit slot therein through which a liquid is discharged to flow down said surface and a lip being a continuation of the slideway surface and terminating in an edge; and an intermediate element having converging sides which terminate in an edge level with the edges of said lips, the converging sides defining with the respective facing lips two component gaps through which liquid from said surfaces flow to form a two-layered free-falling curtain beneath the edge of said intermediate element.

* * * * *